US005522723A

United States Patent [19]

Durst et al.

[11] Patent Number: 5,522,723

[45] Date of Patent: Jun. 4, 1996

[54] BURNER HAVING POROUS MATERIAL OF VARYING POROSITY

[75] Inventors: Franz Durst, Eichenstrasse 12, D-91094 Langensendelbach; Dimosthenis Trimis, Buechenbacher Anlage 7, D-91058 Erlangen; Gerold Dimaczek, Erlangen, all of Germany

[73] Assignees: Franz Durst; Dimosthenis Trimis; Applikations- und Technik Zentrum fuer Energiever- fahrens-, Umwelt- und Stroemungstechnik, all of, Germany

[21] Appl. No.: 392,892

[22] PCT Filed: Jul. 10, 1995

[86] PCT No.: PCT/EP94/02156

§ 371 Date: Mar. 1, 1995

§ 102(e) Date: Mar. 1, 1995

[87] PCT Pub. No.: WO95/01532

PCT Pub. Date: Jan. 12, 1995

[30] Foreign Application Priority Data

Jul. 2, 1993 [DE] Germany ..... 43 22 109.2

[51] Int. Cl.[6] ..... F23D 14/12

[52] U.S. Cl. ..... 431/328; 431/170; 431/7; 122/4 D

[58] Field of Search ..... 431/328, 7, 170; 122/4 D

[56] References Cited

U.S. PATENT DOCUMENTS 1,830,826 11/1931 Cox ..... 431/328
4,154,568 5/1979 Kendall et al. ..... 431/7
4,397,356 8/1983 Retallick ..... 122/4D
5,165,884 11/1992 Martin .

FOREIGN PATENT DOCUMENTS 0256322 2/1988 European Pat. Off. .
0261622 3/1988 European Pat. Off. .

OTHER PUBLICATIONS

Patent Abstract of Japan, vol. 7, No. 257 (M-256) (1402) Nov. 16, 1983, JP, A, 58-140511 / 20 Aug. 83, (Matsushita).

Patent Abstract of Japan, vol. 8, No. 154 (M-310) (1591) Jul. 18, 1984, JP, A, 59-049403 / 22 MAR. 84, (Riyouzou Echigo).

Patent Abstracts of Japan, vol. 11, No. 102 (M-576) (2549) Mar. 31, 1987, JP, A, 61-250409 7 NOV. 86, (Toshiba).

*Primary Examiner*—Carroll B. Dority
*Attorney, Agent, or Firm*—McAulay Fisher Nissen Goldberg & Kiel

[57] ABSTRACT

A burner with a housing enclosing a combustion chamber and with an inlet for a gas/air fuel mixture and an outlet for combustion gas is disclosed. The combustion chamber is filled with a porous material whose porosity varies along the combustion chamber in such a way that the pore size increases in the direction of flow of the gas/air mixture so that a critical Péclet number for the pore size and accordingly for flame development results at a boundary surface or in a determined zone of the porous material, above which number a flame can develop and below which number the flame development is suppressed.

27 Claims, 5 Drawing Sheets

BURNER HAVING POROUS MATERIAL OF VARYING POROSITY

BACKGROUND OF THE INVENTION a) Field of the Invention

The invention is directed to a burner with a housing having a combustion chamber with an inlet for a gas/air fuel mixture and an outlet for the exhaust gas.

b) Description of the Related Art

Conventionally, burners of this type work with a free-burning flame burning the gas/air mixture in the combustion chamber and the hot combustion gas is used as a heat source. In particular, the hot combustion gas is guided past water-carrying pipes for heat transfer so that hot water or steam is generated in these pipes.

Pollutants such as $NO_x$ and CO are formed in such burners. These toxic and health-threatening gases occur at high flame temperatures, by incomplete combustion in unstable flames or at a lower flame temperature which could indeed be reduced, but only at the expense of an unstable flame. Further, incomplete combustion of the gas/air mixture must also be expected, resulting in reduced efficiency.

Various types of burner have been developed to overcome these disadvantages. A survey appears in "Lean-Burn Premixed Combustion in Gas Turbine Combusters", A. Saul and D. Altemark, Vulkan-Verlag, Essen, vol. 40 (1991), 7–8, pages 336–342. The substantial feature in the developments described in this literature for reducing pollutants is primarily a low flame temperature and various steps are undertaken to burn the fuels as completely as possible. The most important measures for achieving a more efficient combustion are superstoichiometry and catalysis. For example, the cited literature indicates a rich-quench-lean combustion chamber, model "LM 2500" by General Electric, which is still in the developmental stage, in which a rich fuel mixture is burned in a first step. In an intermediate step, air is supplied to the gas which has been partially burned in the first step and the resulting lean mixture is burned in a second step. The authors indicate a $NO_x$ content in the gas of less than 190 mg/m$^3$ for this burner.

The literature cited above also describes combustion by catalysts, by means of which complete combustion can be achieved at a low temperature. The literature indicates a $NO_x$ content of less than 20 mg/m$^3$ for catalytic combustion. Catalytic combustion is in development at a number of research facilities but has not yet progressed beyond the research stage. In the opinion of the authors, it is not expected that this type of burner will be used commercially within the next five years.

Problems of stability are not discussed in detail in the cited literature. However, such problems increase in importance the lower the selected flame temperature.

A possibility for stable combustion at low temperatures is discussed in "New Gas Burner and Gas Burner Equipment Technology", a contribution of the gas industry to environmental protection, Otto Menzel, gwf Gas/Erdgas 130, 1989, No. 7, pages 335–364, and in "Development of a low-pollutant premix burner for use in domestic gas heat boilers with cylindrical combustion chambers", H. Berg and Th. Jannemann, Gas Wäarme International, vol. 38 (1989), No. 1, pages 28–34, Vulkan-Verlag, Essen. The "Thennomax" burner described therein has only a low $NO_x$ output. The flame stability in this burner is achieved by means of a heat-conducting burner plate substantially comprising a perforated plate with round bore holes, the gas to be burned flowing through these holes. Due to the elimination of heat via the perforated plate, the flame is practically held to the burner plate resulting in a stable flame.

However, the burner plate is also not a satisfactory assurance of flame stability under all operating parameters. It is stated, for example, that preheating of the mixture to approximately 300° C. should be carded out at high air ratios since this increases the combustion rate and accordingly reduces the lift-up tendency of the flames.

It is clear from the cited prior art that it is possible to achieve a reduction in pollutants by means of lower flame temperature, but the stability of the flame still poses an important unsolved problem.

OBJECT AND SUMMARY OF THE INVENTION

Therefore, it is the primary object of the present invention to provide a burner in which the flame burns steadily at low temperature and with low pollutant emission.

Proceeding from the prior art, this object is met in that the housing contains a porous material with contiguous voids, the porosity of the porous material changing along the combustion chamber in such a way that the pore size increases from the inlet to the outlet in the direction of flow of the gas/air mixture and a critical Péclet number for flame development results for the pore size in a zone or at a boundary surface of the porous material in the combustion chamber, above which number a flame can develop and below which number the flame development is suppressed.

In a departure from the prior art, the invention proposes that the housing be filled with a porous material having the characteristic that it poses resistance to the flow of the gas/air mixture so as to cut back the amount of gas available for combustion. Further, the absorption of combustion heat is improved due to the heat capacity of the porous material in the combustion chamber so that it can be recycled in a more advantageous manner than in the prior art. The porous material also provides cooling which reduces the flame temperature.

At a determined pore size, the chemical reaction of the flame and the thermal relaxation are of identical magnitude so that no flame can develop below this pore size, but free ignition takes place above this pore size. This condition is appropriately described with the aid of the Péclet number which gives the ratio of heat flow by transport to heat flow by conduction. There is a supercritical Péclet number for flame development corresponding to the porosity at which ignition can take place. Since the flame can exist only in the region with the critical Péclet number, a self-stabilizing flame front is produced in the porous material.

The use of a porous material in the combustion chamber also brings about a high heat capacity so that high energy locally stored in the porous material and high efficiency values can be achieved in an advantageous manner. Further, an additional advantage of this high heat capacity consists in that a heat exchanger, e.g., for heating water or generating hot water or steam, can be integrated in the combustion chamber so that heat transfer for exchange of heat is substantially improved over the prior art. The high output density is due to a higher combustion rate in the porous medium and a much larger flame-front surface owing to the porosity.

Another advantage of the porous material consists in that a high turbulence is produced in the flow of the gas/air mixture so that combustion rates up to 50 times higher than normal can be achieved. Above all, this results in improved combustion coefficients and higher output densities. In an embodiment example which will be described in the following, measurements were taken which show that an efficient use of heat of more than 95% can be achieved.

Since the porous material itself cools the flame, correspondingly low flame temperatures are achieved accompanied by low emissions. Therefore, no cooling is required such as is provided in the prior art by superstoichiometry or recycling of combustion gas.

Since the porous material poses resistance to the gas flow itself, the burner according to the invention operates substantially under a broad range of pressure. Accordingly, operation is possible under a wide range of pressures and even under high pressure. This results in a greater range of applications for the burner according to the invention.

According to a further development of the invention, the critical Péclet number is 65 ±25 and, in particular, 65 for natural-gas/air mixtures. This number was determined by testing various gas/air mixtures. However, there is considerable scatter in results depending on the type of gas. Nevertheless, it has been determined that the critical P éclet number is 65 for natural gas/air mixtures regardless of the mixture ratio and composition of the natural gas. These findings show that the Péclet number represents the appropriate parameter for determining the porosity of the material to be selected in a burner according to the invention. The teaching provided allows the person skilled in the art, without extensive prior experimentation, to appoint a critical Péclet number of 65 for a burner according to the invention with regard to the type of operation by means of the porosity of the porous material.

A burner according to the teaching of the present invention can have a continuous transition from a low porosity to a high porosity in the combustion space, wherein the flame development begins at a porosity with the critical Péclet number. However, as has already been discussed, the critical Péclet number can also vary in different gas/air mixtures. With a continuous porosity curve of the porous material in the body or shell, this would have the disadvantage that the flame could shift under different conditions. In order to provide a defined position for flame development, an advantageous further development of the invention provides two zones with different pore sizes in the shell located one after the other in the direction of flow of the gas/air mixture, wherein the first zone after the inlet has a Péclet number for flame development which is smaller than the critical P éclet number and the second zone at a greater distance from the inlet has a Péclet number which is larger than the critical Péclet number.

As a result of these steps, the flame originates at the surface or region between the zones, namely irrespective of the operating parameters which could lead to a change in the critical Péclet number. Thus, the aforesaid step for determining the location of flame origin further increases stability and enables construction of a burner with a wide range of applications.

According to a preferred further development, the first zone has a pore size resulting in a Péclet number less than or equal to 40 and the second zone has a pore size resulting in a Péclet number greater than or equal to 90.

Thus, as a result of this feature, the entire known range of variation of critical Péclet numbers which, as already mentioned, can be 65 ±25, is covered. As will be seen in the following with reference to the embodiment example, the indicated values for designing the zones for Péclet numbers less than Péclet 40 or greater than 90 are realized in a simple manner and make it possible to design a burner for a wide range of uses with widely differing gas/air mixtures.

According to a preferred further development, the porous material is a refractory foamed plastic, a ceramic or metal or metal alloy. The manufacture of such porous materials is known from the prior art.

However, temperature resistance in standard domestic burners need not be particularly high, since the flame is cooled by the porous material itself. Tests have shown that temperatures remain below 1400° C. in burners according to the invention with an output capacity of 90 KW. Therefore, a preferred further development of the invention provides that the porous material is resistant to temperatures up to 1500° C.

Owing to this feature, there are a great many available possibilities for materials for a burner according to the invention, so that the selection of material need not be made on purely technical grounds but, rather, a burner can also be optimized with a view to economical construction and low manufacturing costs.

According to a preferred further development of the invention, the porous material comprises filler, e.g., in the form of bulk material which, if need be, can be consolidated, e.g., by sintering.

Porosity may be produced in a simple manner using the indicated types of material. The porous material can comprise loose layers of granules, but can also be consolidated to form a cohesive porous mass.

The chief advantage of bulk material consists in that it can be introduced into the housing in a simple manner and is very easy to handle in technical respects relating to manufacture. It is also easy to remove bulk material from the housing for burner maintenance, e.g., for cleaning.

According to an advantageous further development of the invention, the bulk material contains metal, a metal alloy or ceramic, in particular steatite, stemalox or $Al_2O_3$. These materials conform in every respect to the technical requirements for a burner according to the invention. The indicated bulk material is easily obtained and affordably priced. This further development accordingly enables a construction of a burner according to the invention which is economical and simple in terms of manufacturing technique.

According to a preferred further development of the invention, the bulk material in the vicinity of the outlet comprises spherical granules with a mean diameter of 5 mm and, in the subsequent region, with a mean diameter greater than 11 mm when the diameter required for achieving the critical Péclet number lies between 5 mm and 11 mm, in particular 9 mm.

When the granules of bulk material are spherical, the uniformity of the bulk material is easily monitored during manufacture. In particular, this applies equally to the attainable porosity which is then determined only by the diameter of the spherical granules and their arrangement in bulk. When using steel, steatite, stemalox or $Al_2O_3$ and natural gas/air mixtures, it has been shown that a Péclet number of 65 is achieved with balls with a diameter of 9 mm and P éclet numbers of 40 and 90 are achieved with balls having diameters of approximately 11 mm and 5 mm, respectively. Thus, the required porosity is easily achieved in this further development, especially since bulk material of the type indicated and of suitable size is readily available. Thus, the required porosities for a burner according to the invention can be realized without great expense.

As was already mentioned with reference to the prior art, emission of $NO_x$ and CO in particular can be reduced by using catalytic materials. For this reason, in a preferred further development, the inner surfaces of the voids of the porous material or the surfaces of the granules of bulk material are coated with a catalytic material.

In a burner according to the invention a large surface is available for interaction with the gas due to the porosity. Accordingly, it can be expected that a catalyst will be considerably more effective here than in the configurations known from the prior art. Moreover, the further development allows a burner according to the invention to be outfitted with catalysts in a substantially simpler manner so that a production model of a catalytic burner suitable for series manufacture will be made possible very quickly.

According to an advantageous further development of the invention the housing is provided, at least in part, with a cooling device. In principle, the heat flowing off into the housing could also be shielded from the external environment by insulating material. However, the advantage of cooling consists in that the heat is absorbed by the coolant and can then be reused. In this way, the efficiency of a burner according to the invention can be further increased.

According to an advantageous further development, the cooling device is constructed as a cooling coil surrounding or forming the housing; a coolant, in particular water, flowing through this cooling coil. Further, a monitoring device can be provided to prevent the supply of fuel to the combustion chamber in the event of coolant failure.

Owing to this feature, the heat absorbed by cooling can be reused since the flowing coolant transports heat which can be taken off at another location. However, it is not possible to rule out the possibility of an interruption in the flow of coolant due to a line break or obstruction in the cooling coil which could cause the outer wall of the burner to heat up resulting in fire or burning. Therefore, it is advisable to provide a monitoring device which prevents the supply of fuel to the combustion chamber in the event of coolant failure.

As a result of these steps, a high efficiency of the burner can be achieved with simultaneous cooling of the outer wall so as to ensure a high measure of safety.

According to an advantageous further development of the invention, a cooling device for exchange of heat is provided in a region where the pore openings of the material are larger. By means of this cooling device, which can be constructed as a cooling coil, the heat in the burner can be carried off as hot water or steam, for example, and can be recycled in additional processes for heating or for operating turbines. In contrast to the prior art, the transfer of heat is not effected by means of direct interaction of the hot gas with the cooling device, but rather principally via the porous material so as to ensure an improved transfer of heat compared to the prior art. This feature also serves to increase efficiency.

According to a preferred further development, the housing is provided with cooling means connected in series with the cooling device for heat transfer. Due to this step, the energy taken over by the coolant in cooling the housing is guided in the same circuit used for transfer of the heat in the coolant. The coolant is preferably first used to cool the housing and is then guided into the interior of the burner, where it interacts with the porous material at high temperature. By means of this development, the heat generated by the burner is absorbed in its entirety in the coolant so as to further increase efficiency.

The more effectively the heat generated in the burner is transtarred to the cooling device inside the burner, the more effective the transmission of heat. Further, the cooling device in the burner forms an additional resistance to flow which can be taken into account in the design of porous material in the region of the cooling device. The cooling device then acts in a manner similar to the porous material. The amount of porous material can be reduced and a more effective transmission of heat is also achieved when the cooling device itself is so constructed according to a further development that it acts, at least in part, as porous material and/or takes the place of porous material.

In order to optimize a burner, the distance between the cooling device and flame should also be selected in the most advantageous manner possible. Although, the highest temperature is reached in the vicinity of the flame, materials suitable for lower temperatures can also be selected for construction of the cooling device if the latter is located outside the flame region. Moreover, the flame is not additionally cooled by the cooling device when the latter is located outside the flame region, which adds to the stability of the flame. For this reason, an advantageous further development of the invention provides that the distance between the cooling device and the region with the critical Péclet number is at least sufficiently great to prevent the cooling device coming into contact with the flame. This has only a negligible effect on the heat transfer from the flame to the cooling device due to the good heat conduction in the porous material.

In order to prevent the cooling of the outer housing from influencing the flame, an advantageous further development of the invention provides that an additional device, e.g., an insert in the combustion chamber, causes a gap of more than 1 mm to be formed between the inner wall of the housing and the insert, the porous material being located in this gap. The CO emissions resulting from incomplete or unstable combustion are accordingly further suppressed.

Tests on embodiment examples have shown that the greatest efficiency is achieved when the porosity is produced by bulk material and the cooling device is arranged at a distance of 2 to 4 granule sizes of the bulk material from the boundary region having the critical Péclet number 65. In general, according to a further development, it can be expected that the most favorable conditions will prevail when the cooling device is far enough away from the zone with the porosity required for the critical Péclet number that it does not penetrate into the flame region.

According to another preferred development, an ignition device is arranged at the burner in such a way that the ignition of the gas/air mixture is effected in a region with a porosity having the critical Péclet number.

In principle, the gas/air mixture could be ignited at any location in the burner at which a combustible gas/air mixture is present, e.g., from the outlet. According to the further development, however, ignition is effected in a region in which the porosity has the critical Péclet number. Accordingly, the flame is ignited precisely in the region where it will also burn in a stable state. In this way, great stability is already achieved at the moment of ignition, since at other locations the flame would first have to flash back, which is impossible at high flow speeds of the fuel. In this case, ignition could only be effected by temporarily reducing the flow of fuel. Thus, this feature extensively reduces the apparatus cost for a burner according to the invention, since there is no need to regulate the ignition process.

According to another advantageous further development of the invention, a flame trap is arranged between the inlet and the porous material. Owing to the porous material, the flame is not expected to flash back since the Péclet number in the inlet region does not allow development of a flame. Nevertheless, a flame trap is provided chiefly for safety reasons. This may be important, for example, if the highly porous bulk material is unintentionally introduced into the inlet region after maintenance cleaning.

Since it is not required under normal circumstances, the flame trap should be constructed as simply as possible. According to an advantageous further development, the flame trap is a plate having a plurality of holes with a diameter less than the critical quenching diameter for the respective fuel. It has been shown that this flame trap is effective with natural gas/air mixtures. Its great advantage consists above all in its simple production and very economical construction. Costs for the flame trap are accordingly kept low and affordable so that an additional flame trap can be used at a reasonable expense, although it is not normally necessary for the burner according to the invention.

Due to the high output density and the great number of materials for absorbing heat, the burner according to the invention can also easily be operated as a condensing boiler since the combustion gas temperature is sharply reduced in such condensing boilers. However, the occurring condensate must be carried off. This can be achieved in a simple manner in the burner according to the invention as it has been demonstrated in test models that these burners can be operated in any attitude, even with flame development opposed to gravitational force. In a burner in which the outlet is arranged at bottom, the condensate could simply flow out through this outlet so that no additional steps need be taken. Therefore, it is provided in a preferred further development of the invention that the inlet, outlet and porous material are so arranged that occurring condensate can flow off through the outlet.

Further steps and advantages of the invention are also indicated in the following embodiment examples described with reference to the drawings.

DESCRIPTION OF THE PREFERRED EMBODIMENTS

Flame development in porous material has already been researched and described by a number of scientists, in particular by V. S. Babkin, A. A. Korzhavin and V. A. Bunev in "Propagation of Premixed Gaseous Explosion Flames in Porous Media", Combustion and Flame, vol. 87, 1991, pages 182 to 190. These authors describe the following propagation mechanism for flames.

In porous material, turbulence is produced in the fuel flow. Positive feedback between flame acceleration and production of turbulence is damped by local suppression of chemical reactions due to intensive heat transfer in the turbulent flame zone. When the characteristic time period for thermal equilibrium is less than chemical conversion, flame formation is prevented. Moreover, since various velocities occur in turbulent flows, the components of the flame with maximum velocities are suppressed so as to produce a stable flame propagation.

Experiments conducted by the authors led to a critical Péclet number of 65±25 for flame propagation in porous material, wherein the variance results substantially from extremely different gas compositions. But, essentially, a Péclet number of 65 can be expected in natural gas/air mixtures.

The Péclet number can be calculated by the following equation:

$$P_e=(S_L d_m c_p \phi)/\lambda,$$

where $S_L$ is the laminar flame velocity, $d_m$ is the equivalent diameter for the mean void of the porous material, $c_p$ is the specific heat of the gas mixture, $\phi$ is the density of the gas mixture and $\lambda$ is the thermal conductivity of the gas mixture. The equation shows that the conditions for flame development substantially depend on gas parameters and the characteristics of the porous material only enter into the equation by way of $d_m$. The Péclet number is thus substantially independent from the material properties and only dependent on porosity. Thus, a wide range of materials and geometric shapes can be used for porous material in the burners according to the invention.

For the rest, all of the values included in the equation are measurable so that, with the aid of the indicated equation, a technical teaching is provided which can be applied to a wide range of gas mixtures.

Figure 1:
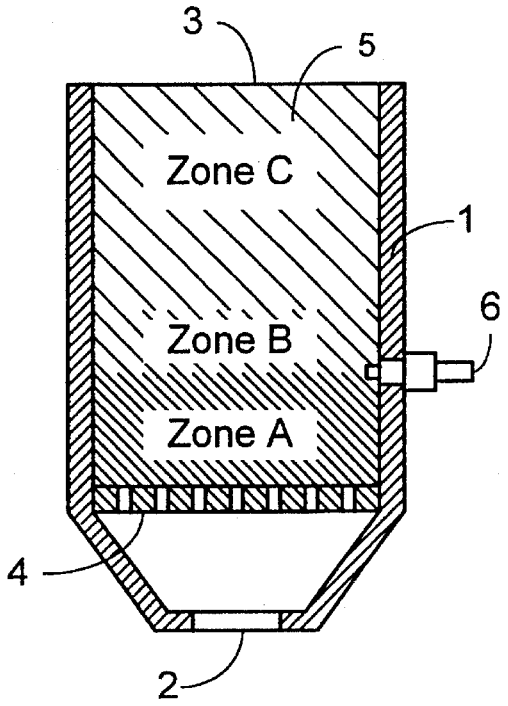
FIG. 1 shows a first embodiment form of the burner with three zones.

FIG. 1 shows a schematic view of a burner with a housing 1 which has an inlet 2 for the gas/air mixture and an outlet 3 for the combustion gases. A flame trap 4 dividing the interior space of the housing 1 is provided at a distance from the inlet 2. The portion of the interior space of the housing 1 located between the flame trap 4 and the outlet 3 is filled with a porous material. Further, an ignition device 6 is provided for igniting the gas mixture.

The gas/air mixture enters through the inlet 2 and the combustion gases exit the burner through the outlet 6. The porous material 5 has locally varying porosities corresponding to the different shaded zones A, B and C, In zone A, the pores are so small that the resulting Péclet number is smaller than the critical Péclet number (65 for natural gas/air mixtures). The critical Péclet number is the limiting value above which a flame can occur and below which a flame is suppressed. In zone C, the Péclet number is substantially larger than the critical Péclet number so that a flame can develop in this region. Zone B represents a transitional region within which the porosity reaches the Péclet number.

According to the findings presented in the preceding concerning flame development in porous material, the flame can only occur in zone B, specifically only at those locations where the porosity reaches the critical Péclet number. The porous material cools the flame so that only a small amount of $NO_x$ is produced. The inner surfaces of the voids of the porous material, in particular in zone B, can also be coated by a catalyst so as to achieve a further reduction of $NO_x$ and CO components in the combustion gas.

As a result of the physical laws for flame development in porous material discussed above, the flame in zone B is stabilized, namely at those locations where the gas/air mixture just reaches the critical Péclet number. However, this also means that flaming can shift in the event of drastic changes in the physical parameters within region B so that local flame stability does not result in principle. On the other hand, the transitional layer provided by zone B has the advantage that the flame front stabilizes in the presence of the smallest possible voids so as to ensure optimum heat transfer from the flame to the porous material.

Figure 2:
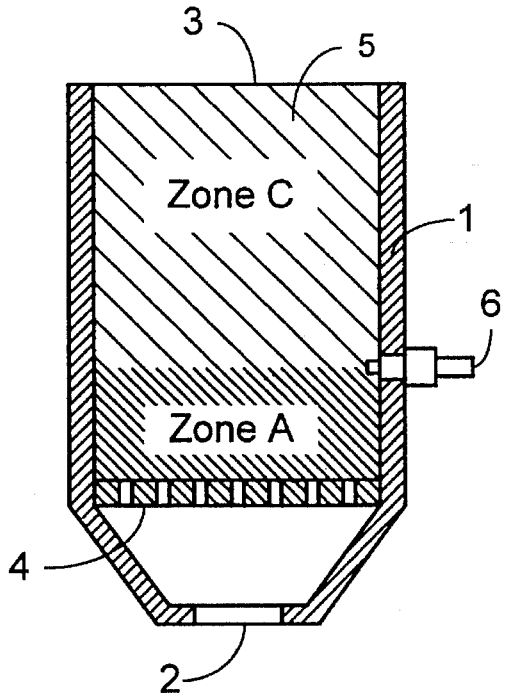
FIG. 2 shows another embodiment form of the burner with two zones.

However, if a locally stable flame is important, a burner according to the embodiment example shown in FIG. 2 can be used. Zone B has been omitted in this embodiment example compared to that shown in FIG. 1 so that there are only two zones A and C. In this instance, the flame stabilizes at the boundary layer between zone A and zone C due to the aforementioned laws. The flame is thus determined by the boundary surface and is therefore locally stable. In view of the variance of ±25 of the indicated Péclet number of 65, it is advantageous to provide zone A with a porosity whose P éclet number is less than 40 and to provide zone C with a porosity corresponding to a Péclet number greater than 90. In this case, the boundary layer determines the location of flame development for a wide range of gas/air mixtures so as to ensure stability for a wide range of gas parameters.

Different materials, e.g., ceramics, can be used for the porous material. However, it is also possible to use refractory foamed plastics. For the present purposes, bulk material will be used as porous material. In bulk material with round granules, the parameter $d_m$ for porosity used in the equation for the Péclet number can be calculated as $d_m=\delta/2.77$, due to geometric considerations, where $\delta$ is the diameter of the spherical granules of the bulk material.

Figure 3:
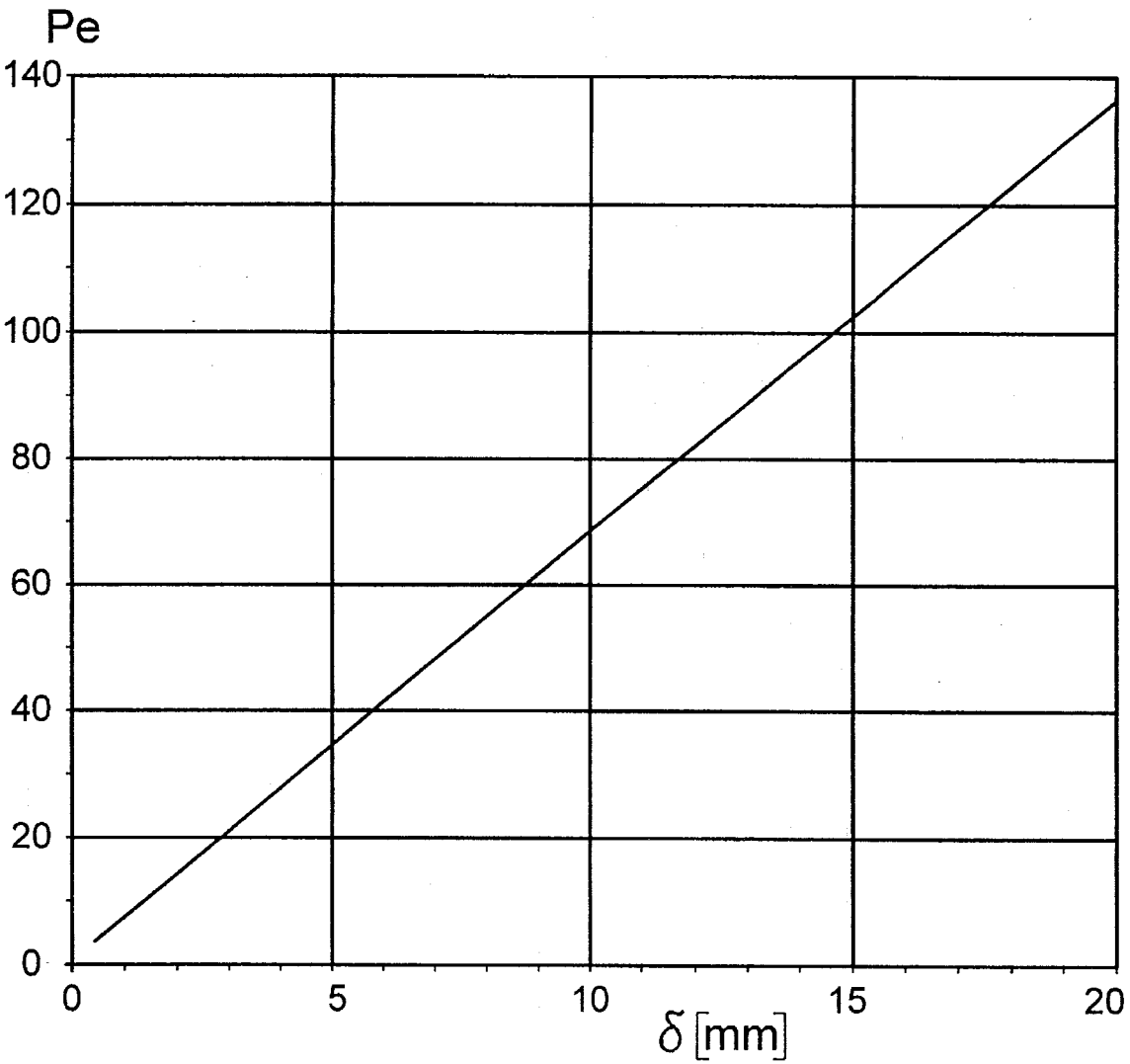
FIG. 3 shows a chart for Péclet numbers as a function of the spherical diameter in spherical bulk materials.

In accordance with the equation indicated above, Péclet numbers, shown in FIG. 3, were calculated for a natural gas/air mixture as a function of diameter $\delta$. A stoichiometric laminar flame velocity $S_L$ of 0.4 mm per second is assumed for calculating purposes. The Péclet number of 65 is achieved with a spherical radius of 9 mm, while the indicated Péclet numbers of 40 and 90 result for radii of 6 mm and 12.5 mm, respectively.

In a test construction according to FIG. 2, granules with diameters of 5 mm were used in zone A and granules with diameters of 11 mm were used in zone C. In so doing, very different test materials were used, e.g., polished steel balls and ceramic granules of widely varying composition and size such as steatite, stemalox or $Al_2O_3$. The advantages according to the invention were demonstrated in all materials.

Figure 4:
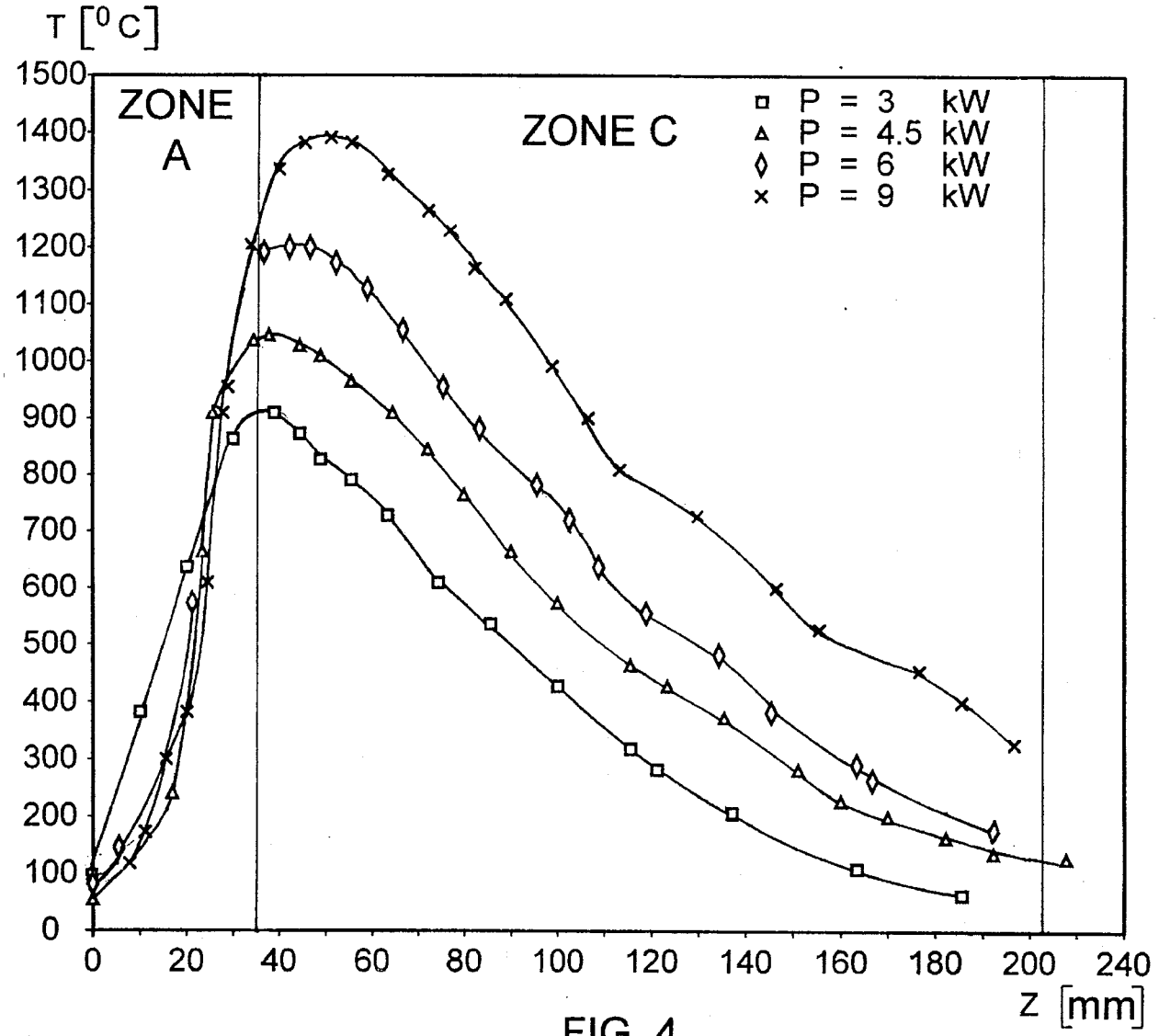
FIG. 4 shows a chart for the temperature curve within the porous material in the embodiment example according to FIG. 2.

FIG. 4 shows the temperature curve in the direction of flow of the gas/air mixture in a test burner of this type for different outputs, wherein the shell was cooled from the outside. It was demonstrated that the highest temperature was below 1500° C. even at high outputs of 9 kW. Therefore, all materials which are stable up to temperatures of 1500° C. can be used.

FIG. 4 shows a first vertical line representing the boundary surface between zone A and zone C. It is clear that the highest temperature occurs at the boundary surface or shortly after the boundary surface in zone C.

Further, it will be seen from FIG. 4 that the temperatures drop sharply toward the outlet 3 (second vertical line). Thus, in a burner according to the invention, a combustion gas temperature below dew point can be achieved resulting in the advantages of a condensing boiler. However, the occurring condensate must be carried off. It has been shown that the operation of the burner is stable regardless of its attitude with respect to the earth's gravitational field so that it can also be operated horizontally or with the outlet 3 at the bottom. In this latter arrangement, the condensate can flow out of the burner.

The low gas temperature at the outlet also shows that the heat of the burned gas/air mixture is almost completely lost to the porous material which enables the construction of a highly efficient heat exchanger. With a burner according to the embodiment example shown in FIG. 2, it is possible to construct a water heater with an output of 5 kW, a combustion gas temperature of 60° C. and an efficiency of 95%. In so doing, it was possible to maintain small overall dimensions of the burner with a length of only 15 cm and a diameter of 8 cm. The small dimensions are chiefly due to the high output density which can be achieved by means of porous material.

FIG. 4 also shows that the highest temperatures occur immediately after the boundary surface between zone A and zone C. Consequently, for purposes of generating hot steam, the transfer of heat from the flame to the heated water should take place in the vicinity of this boundary surface. A cooling device which guides the water provided for generating steam should therefore extend in the region of the porous material which is at a distance of approximately 3 cm from the boundary surface.

In any event, it is generally advisable not to arrange the cooling device too close to the flame since, in order to maintain its stability, the flame itself should not be cooled. For this reason, the cooling device is advantageously arranged in the vicinity of the boundary layer but not in the region of the flame. If problems relating to material should arise in the construction of the cooling device owing to the high temperatures, greater distances are to be preferred.

Figure 5:
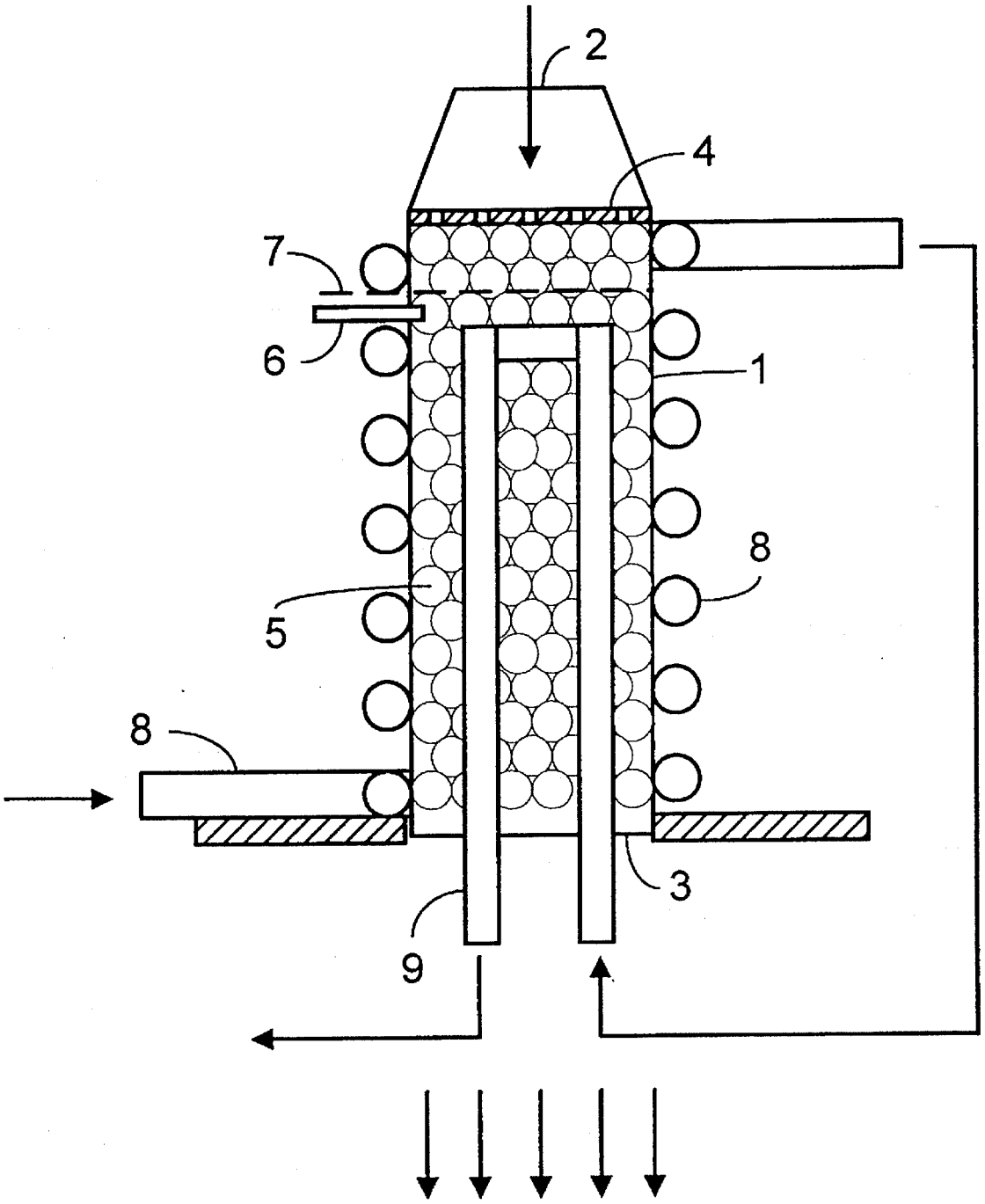
FIG. 5 shows a section through a burner designed as a water heater or steam generator which corresponds to the embodiment example shown in FIG. 2, but with the outlet arranged at the bottom.

FIG. 5 shows the schematic construction of a burner suitable for heating water and for generating steam. This construction again substantially comprises the housing 1, inlet 2, outlet 3, flame trap 4, ignition device 6 and porous material 5. The burner is arranged with its outlet 3 at the bottom so that condensate can flow off easily. The porous material 5 is only indicated schematically by balls of identical dimensions. This does not conform to actual circumstances since the porosity of the porous material changes along the direction of flow of the gas/air mixture and the balls have a smaller diameter in the inlet region than in the outlet region.

The boundary surface between zone A and zone C, which were described in the preceding, is indicated by a dashed line 7. As has already been explained, the flame occurs at this boundary surface 7 and transmits its heat to the porous material substantially within a range of a few centimeters in region C.

An outer cooling device which encloses and may even form the housing 1 is provided in addition. This cooling device 8 can be constructed as cooling coils arranged around the housing 1 and prevents heat from being carried away. Water flows through the cooling coil, which is provided with a water monitor which interrupts the flow of gas/air mixture to the inlet 2 in the event of coolant failure so that the housing 1 is always cooled during operation of the burner. This ensures that the outer wall will not overheat and, in turn, prevents burn injuries when the housing is touched and prevents the housing from setting off fires. The heat carried off from the housing wall through the cooling coil can be recycled, resulting in increased efficiency for generating hot water or steam.

FIG. 5 also shows the arrangement of an inner cooling device 9 which extends from the outlet 3 until just before the boundary surface 7 leading into the porous material of zone C.

The inner cooling device 9 is only shown schematically. In practice, it can take the form of a coil, for example, so as to ensure the optimum transfer of heat from the porous material 5. However, more complicated embodiment forms of the cooling device 9 are also conceivable. For example, it can even form the porous material itself or can contribute to porosity so as to further improve the transfer of heat.

The outer cooling device 8 is connected in series with the inner cooling device 9 so that the water which has already been preheated by the housing 1 is guided into the inner cooling device 9 and used to heat the water or generate steam.

Figure 6:
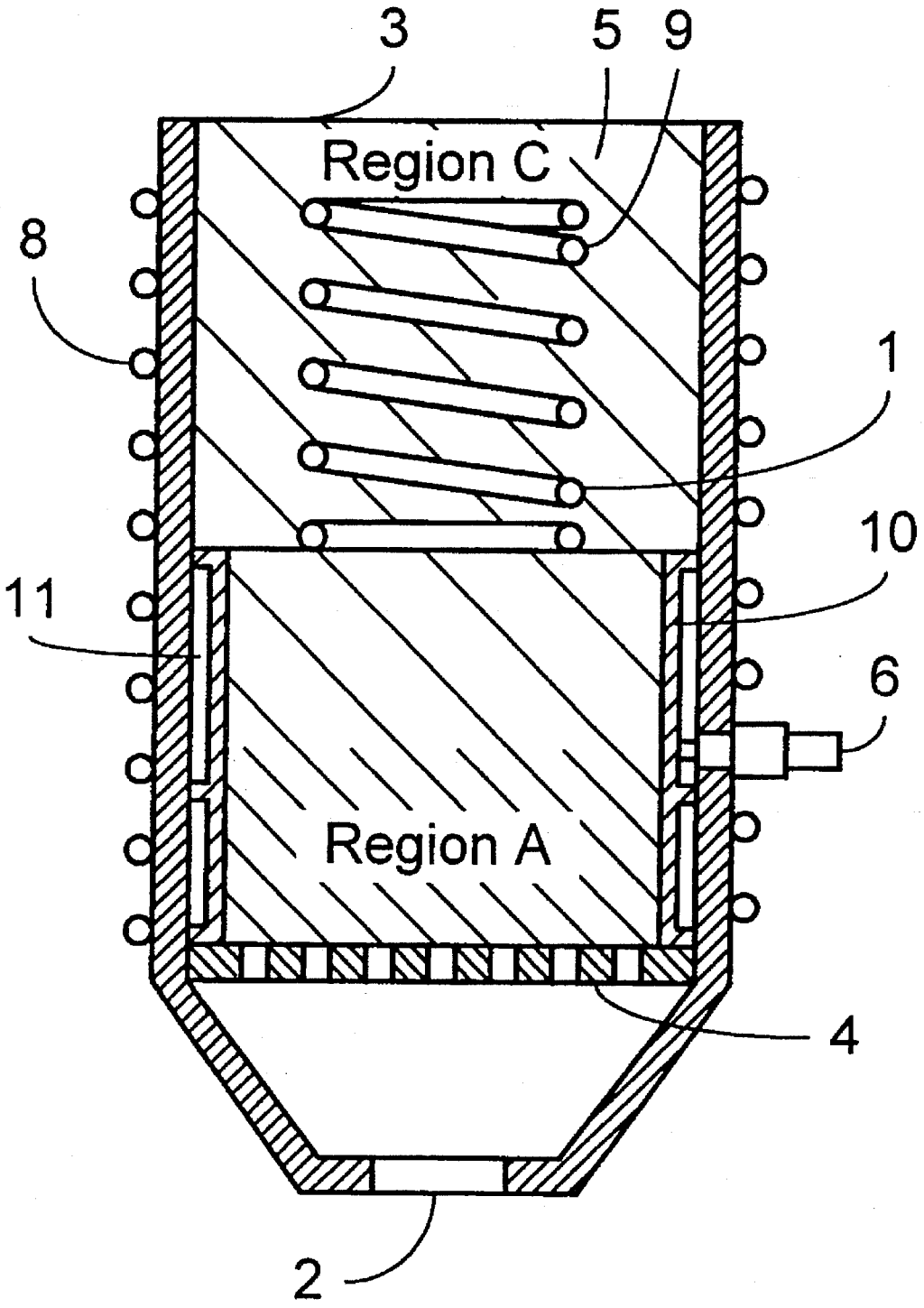
FIG. 6 shows a section through a burner provided with an insert.

In order to prevent the flame in the combustion chamber from being affected by excessive cooling by the outer cooling device 8, an insert 10 is provided in the flame region of the combustion chamber as will be seen from FIG. 6. The insert 10, formed by an appropriate material, receives the porous material 5 and shields the inner wall of the housing 1 from direct heat radiation. The insert 10 can also be constructed so as to be arranged at a distance from the inner wall of the housing 1 so that a gap 11 which does not contain any combustible gas/air mixture is formed between the inner wall and the insert 10. This construction of the combustion chamber in the flame region brings about a further reduction in CO emissions occurring as a result of incomplete or unstable combustion.

The flame trap 4 prevents the flame from flashing back. In principle, it is not needed in the burner according to the invention, since the flame cannot penetrate to the inlet 2 owing to the low Péclet number in zone A. It is only provided to increase safety. In the embodiment example shown in FIG. 5, the flame trap is made of a steel plate with a thickness of 4 mm in which a plurality of holes are bored with a diameter of 1 mm, wherein the density of the holes is less than $20/cm^2$.

The ignition device 6 is located in the vicinity of the boundary surface 7 so as to enable a particularly effective ignition. In the embodiment example, the flame burns at the boundary surface 7 in a self-stabilizing manner.

Tests were also conducted in which ignition was effected from the outlet 3. However, this type of ignition was disadvantageous since the velocity of the flame front of the free flame is comparatively low compared to the flame velocity in the porous material. A flashback of flame from the outlet 3 to the boundary surface 7 was only possible when the average speed of the gas/air mixture at the outlet 3 was kept low. Thus, ignition from the outlet 3 would require additional regulation in which the flow rate of the gas/air mixture is first cut back and then increased again after firing at the boundary surface 7. This results in the advantage of ignition in the vicinity of the boundary surface 7 which does not require complicated regulating solutions for the gas/air mixture.

The embodiment examples described in the preceding show the basic construction of the burner according to the invention with low temperature, good heat transfer and a stable flame. In the event of incomplete combustion, it is also possible to operate the burner according to the invention by superstoichiometry or to improve combustion by providing catalytic material in the porous material which would further reduce the harmful components in the combustion gas.

While the foregoing description and drawings represent the preferred embodiments of the present invention, it will be obvious to those skilled in the art that various changes and modifications may be made therein without departing from the true spirit and scope of the present invention.

What is claimed is:

1. A burner comprising:

a housing having a combustion chamber with an inlet for a gas/air fuel mixture and an outlet for the combustion gas;

said housing containing a porous material with contiguous voids, the porosity of said porous material changing along said combustion chamber so that pore size increases from said inlet to said outlet in the direction of flow of the gas/air mixture and a critical Péclet number for flame development results for the pore size in a zone or at a boundary surface of said porous material in the combustion chamber, above which number a flame can develop and below which number flame development is suppressed.

2. The burner according to claim 1, wherein the critical Péclet number is 65±25.

3. The burner according to claim 1, wherein two zones with different pore sizes, located one after the other in the direction of flow of the gas/air mixture, are provided in the housing, said first zone after the inlet having a Péclet number smaller than the critical Péclet number and said second zone at a greater distance from the inlet having a Péclet number which is larger than the critical Péclet number.

4. The burner according to claim 3, wherein said first zone has a pore size resulting in a Péclet number less than or equal to 40 and said second zone has a pore size resulting in a Péclet number greater than or equal to 90.

5. The burner according to claim 1, wherein the porous material is heat-resistant sponge plastic, ceramic or metal or a metal alloy.

6. The burner according to claim 5, wherein the porous material is resistant to temperatures up to 1500° C.

7. The burner according to claim 1, wherein the porous material comprises filler in the form of bulk material which can be consolidated by sintering.

8. The burner according to claim 7, wherein the bulk material contains metal or ceramic, in particular steatite, stemalox or $Al_2O_3$.

9. The burner according to claim 7, wherein the bulk material in the vicinity of the inlet comprises spherical granules with a mean diameter of 5 mm and, in the subsequent region, with a mean diameter greater than or equal to 11 mm when the diameter required for achieving the critical Péclet number lies between 5 mm and 11 mm at atmospheric pressure.

10. The burner according to claim 1, wherein inner surfaces of the voids of the porous material or the surfaces of the granules of bulk material are coated with a catalytic material.

11. The burner according to claim 1, wherein the housing is provided, at least in part, with a cooling device.

12. The burner according to claim 11, wherein the cooling device is constructed as a cooling coil surrounding or forming the housing, a coolant flowing through said cooling coil.

13. The burner according to claim 1, wherein a cooling device for exchange of heat is arranged in a region where the pore openings of the material are larger.

14. The burner according to claim 13, wherein the cooling device of the housing is connected in series with the cooling device for exchange of heat.

15. The burner according to claim 13, wherein the distance between the cooling device and zone or the boundary source with the critical Péclet number is at least sufficiently great to prevent the cooling device coming into contact with the flame.

16. The burner according to claim 13, wherein the inner wall of the housing is shielded from direct heat radiation at least in the flame region by means of an additional device.

17. The burner according to claim 16, wherein the device is arranged at a distance from the inner wall of the housing so as to leave a gap not containing the gas/air mixture.

18. The burner according to claim 13, wherein the cooling device is far enough from the zone having the porosity required for the critical Péclet number that it does not penetrate into the flame region.

19. The burner according to claim 1, wherein an ignition device is arranged in such a way that ignition of the gas/air mixture is effected in a region with a porosity having the critical Péclet number.

20. The burner according to claim 1, wherein a flame trap is arranged between the inlet and the porous material.

21. The burner according to claim 20, wherein the flame trap is a plate having a plurality of holes with a diameter less than the critical quenching diameter for the respective fuel mixtures.

22. The burner according to claim 1, wherein the inlet, outlet and porous material are arranged so that condensate can flow off through the outlet.

23. The burner of claim 2, wherein the critical Péclet number is 65 for natural gas/air mixtures.

24. The burner of claim 8, wherein the bulk material contains a substance selected from the group of steatite, stemalox or $Al_2O_3$.

25. The burner according to claim 9, wherein the critical Péclet number is 9 mm.

26. The burner according to claim 12, wherein said coolant is water.

27. The burner according to claim 16, wherein the additional device is an insert of suitable material.

* * * * *

UNITED STATES PATENT AND TRADEMARK OFFICE

CERTIFICATE OF CORRECTION

PATENT NO. : 5,522,723

DATED : June 4, 1996

INVENTOR(S) : Franz Durst et al

It is certified that error appears in the above-identified patent and that said Letters Patent is hereby corrected as shown below:

On the title page, Item [22], change "Jul. 10, 1995" to read

--Jul. 1, 1994--

Signed and Sealed this

Tenth Day of September, 1996

Bruce Lehman

*Attest:*

BRUCE LEHMAN

*Attesting Officer*

*Commissioner of Patents and Trademarks*